United States Patent [19]

Vataru et al.

[11] Patent Number: 4,857,073

[45] **Date of Patent: * Aug. 15, 1989**

[54] DIESEL FUEL ADDITIVE

[75] Inventors: Marcel Vataru, Los Angeles; Mark S. Filowitz, Fullerton, both of Calif.

[73] Assignee: Wynn Oil Company, Fullerton, Calif.

[ * ] Notice: The portion of the term of this patent subsequent to Jan. 10, 2006 has been disclaimed.

[21] Appl. No.: 182,299

[22] Filed: Mar. 28, 1988

Related U.S. Application Data

[63] Continuation-in-part of Ser. No. 89,598, Aug. 27, 1987.

[51] Int. Cl.[4] ..... C01L 1/18; C01L 1/22

[52] U.S. Cl. ..... 44/57; 44/63; 44/71; 44/77

[58] Field of Search ..... 44/63, 71, 77, 57

[56] References Cited

U.S. PATENT DOCUMENTS

| | | | |
|---|---|---|---|
| 2,472,152 | 6/1949 | Farkas . | |
| 2,891,851 | 6/1959 | Bailey | 44/77 |
| 3,442,630 | 5/1959 | Annable . | |
| 3,951,614 | 4/1976 | Honnen et al. | 44/71 |
| 4,045,188 | 8/1977 | Hirschey . | |
| 4,274,973 | 6/1981 | Stanton et al. | 252/34.7 |
| 4,305,731 | 12/1981 | Sung . | |
| 4,394,135 | 7/1983 | Andress . | |
| 4,509,953 | 4/1985 | Itow . | |
| 4,518,395 | 5/1985 | Petronella . | |
| 4,684,373 | 8/1987 | Vataru et al. | 44/71 |

FOREIGN PATENT DOCUMENTS

| | | |
|---|---|---|
| 0078328 | 10/1981 | European Pat. Off. . |
| 0165776 | 6/1985 | European Pat. Off. . |
| 0255115 | 7/1987 | European Pat. Off. . |
| 2165026 | 12/1971 | Fed. Rep. of Germany . |
| 1179042 | 7/1957 | France . |
| 673125 | 11/1949 | United Kingdom . |

OTHER PUBLICATIONS

International Publication WO 85/01956 entitled "Deposit Control Additives—Hydroxy Polyether Polyamines".

*Primary Examiner*—Jacqueline V. Howard
*Attorney, Agent, or Firm*—William W. Haefliger

[57] ABSTRACT

An additive composition for use in Diesel fuel to be combusted in a Diesel engine, the composition comprising, in admixture form:

(a) about 6.0 weight percent di-tertiary butyl peroxide,
(b) about 1.0 weight percent tall oil fatty imidazoline,
(c) about 0.5 weight percent neo decanoic acid,
(d) the balance being a hydrocarbon solvent carrier thoroughly mixed with the peroxide, imidazoline, and acid.

8 Claims, No Drawings

DIESEL FUEL ADDITIVE

This application is a continuation-in-part of Ser. No. 89,598, filed Aug. 27, 1987.

This invention relates to a Diesel fuel additives. More particularly, it relates to novel additive composition which can be added to the fuel of an ordinary Diesel engine and is capable of increasing the efficiency of fuel combustion within the engine, thereby boosting engine power, improving fuel economy, and reducing objectionable tailpipe emissions, especially particulates and smoke.

BACKGROUND OF THE INVENTION

In view of the many Diesel powered vehicles and engines operating in the world, it is evident that improvements in engine efficiency can result in substantial savings of petroleum and significant reductions in air pollution.

Combustion is an extremely complex reaction, especially under the conditions that exist in the cylinders of an internal combustion engine. The efficiency of combustion depends on the amount of oxygen that is present to support it and the speed of reaction. For this purpose it is desirable to incorporate an additive directly into the fuel that is capable of liberating supplemental oxygen in the combustion chamber and accelerating the combustion free radical chain reaction.

SUMMARY OF THE INVENTION

In accordance with the present invention, the efficiency of combustion within an internal combustion Diesel engine is improved, and increased fuel economy of a Diesel powered vehicle is realized, by incorporating into the Diesel fuel a minor amount of a particular additive composition comprising the following components: di-tertiary butyl peroxide, tall oil fatty imidazoline, neo decanoic acid, and a hydrocarbon solvent carrier.

That composition is proportions to be stated, and which can be usefully employed in the form of an aftermarket additive to be poured into the fuel tank, added to bulk storage tanks, or added at the refinery, is capable of significantly boosting engine horsepower, improving fuel economy, and reducing particulates, smoke, and HC and CO in tailpipe emissions.

More particularly, the proportioned components of the composition of the invention comprise essentially the following:

(a) about 6.0 weight percent di-tertiary butyl peroxide, an organic peroxide, which constitutes the source of supplemental oxygen and free radical chain reaction acceleration for the Diesel fuel to be rapidly and more completely combusted in the combustion chamber;

(b) about 1.0 weight percent tall oil fatty imidazoline, an ashless detergent to maintain fuel system (including combustion chamber and injector cleanliness), absorb moisture, and resist rust and corrosion;

(c) about 0.5 weight percent neo decanoic acid, acting to enhance the effectiveness of (a) and (b); the particular 2/1 relative amounts of tall oil fatty imidazoline to neo decanoic acid is important to achieving Diesel fuel stability and shelf life, and detergency which assists the di-tertiary butyl peroxide in its effects on exhaust particulate reduction, and exhaust and smoke reduction; as set forth in the following test results. The acid acts as an initiator and stabilizer for the above peroxide, and helps provide resistance to microbial attack in diesel fuel;

(d) the balance percentage amount of the additive being a hydrocarbon solvent carrier, one very desirable carrier being a low-odor paraffin solvent. Examples are refined kerosene and heating (fuel) oil, with the following characteristics:
specific gravity (15.5° C.) 0.8 (6.6 pounds/gallon);
flash point (Pensky-Marten) 65°–100° C.;
boiling point range 190°–244° C.;
sulfur content 0.02 or less.

Between 0.58 and 0.68 percent by volume of the above composition is to be used as an additive in Diesel fuel, the balance percentage by volume being the Diesel fuel. preferably 0.60 by volume of the additive is used in admisture with the Diesel fuel, to achieve the test results given below.

If an excess of either the imidazoline or the neo decanoic acid, above the amount disclosed in relation to the otehr or to the peroxide, is employed in the additive, it affects the peroxide, inhibiting its functioning, as stated; adn if less of either the imidazoline or the acid, below the amount disclosed in relation to the other or to the peroxide, is employed in the additive; the desirable advantages of the imidazoline or of the acid, as stated are reduced.

If an amount of the additive, less than the amount disclosed, and in relation to the Diesel fuel, is added to the Diesel fuel, the proportion of particulates in the combustion gases substantially increases; and if an amount of the additive, more than the amount disclosed and in relation to the Diesel fuel, is added to the Diesel fuel, the cost of the admixture with the fuel increases, undesirably, without proportionate benefit.

In the following, the additive composition was 6.0% by weight di-tertiary butyl peroxide; 1.05 by weight tall oil fatty imidazoline; 0.5 by weight neo decanoic acid; and the balance of the additive composition was heating oil, as referred to above. The percent by volume of the additive employed in admixture with Diesel fuel was 0.60, the balance percentage by volume being Diesel fuel.

I

HORSEPOWER vs. RPM - 1977 MERCEDES DIESEL
INDEPENDENT LABORATORY CHASSIS DYNAMOMETER TESTS

| | | | HORSEPOWER | | |
|---|---|---|---|---|---|
| SPEED (MPH) | ENGINE RPM | GEAR | WITHOUT ADDITIVE | WITH ADDITIVE | CHANGE |
| 35 | 2700 | 2 | 35.0 | 36.0 | +2.86 |
| 40 | 3120 | 2 | 37.0 | 40.0 | +8.11 |
| 45 | 3440 | 2 | 40.0 | 40.0 | — |
| 50 | 3850 | 2 | 41.0 | 41.5 | +1.22 |
| 55 | 4240 | 2 | 38.0 | 40.5 | +6.58 |

-continued

| HORSEPOWER vs. RPM - 1977 MERCEDES DIESEL INDEPENDENT LABORATORY CHASSIS DYNAMOMETER TESTS | | | | | |
|---|---|---|---|---|---|
| | | | HORSEPOWER | | |
| SPEED (MPH) | ENGINE RPM | GEAR | WITHOUT ADDITIVE | WITH ADDITIVE | CHANGE |
| 60 | 2600 | 3 | 34.0 | 37.5 | +10.29 |

II

| EFFECT ON FUEL ECONOMY - URBAN FIELD TESTS CUMMINS DIESEL BUSES | | | |
|---|---|---|---|
| | MILES/GALLON | | |
| ENGINE TYPE | WITHOUT ADDITIVE | WITH ADDITIVE | % IMPROVEMENT |
| V6 - 155 | 5.158 | 5.442 | +5.5 |
| V8 - 210 | 3.017 | 3.379 | +12.0 |

| DIESEL EMISSION DATA (RELATIVE TO DIESEL FUEL WITHOUT ADDITIVE) | | | |
|---|---|---|---|
| 1. | INDEPENDENT LABORATORY ENGINE TEST % CHANGE IN EMISSIONS* 50% LOAD | | |
| | HC | CO | PARTICULATES |
| | −12 | −1.6 | −33 |
| 2. | BRITISH LEYLAND BUS-SMOKE TEST (DIESEL FUEL) | | |
| | | HARTRIDGE SMOKE METER - % OPACITY | |
| WITHOUT ADDITIVE | | Run 1 | 100% |
| | | Run 2 | 100% |
| WITH ADDITIVE | | Run 1 | 15% |
| | | Run 2 | 20% |
| | | Run 3 | 10% |

*Relative to Diesel fuel without additive.

As stated in U.S. Pat. No. 2,891,851, Diesel fuel is defined, in accordance with ASTM Designation D0975, as having a minimum flash point of 100° F., a minimum kinematic viscosity of 1.4 centistokes at 100° F., and depending upon the particular grade a cetane number of at least 40 (grades 1-D and 2-D) or at least 30 (grade 4-D), and a carbon residue maximum of 0.15% (grade 1-d) or 0.35% (grade 2-D). Diesel fuels generally boil over the range of from about 300° F. or 350° F. to upwards of 600° F.

Diesel fuel may include any of the various mixtures of hydrocarbons which can be used as diesel fuels and thus include distillate and residual fuel oils, blends of residual fuel oils with distillates, gas oils, recycled stock from cracking operations and blends of straight run and cracked distillates.

We claim:

1. A Diesel fuel additive composition comprising:
(a) about 6.0 weight percent di-tertiary butyl peroxide,
(b) about 1.0 weight percent tall oil fatty imidazoline,
(c) about 0.5 weight percent neo decanoic acid,
(d) the balance being a hydrocarbon solvent carrier.

2. The additive composition of claim 1 wherein the solvent is a low odor paraffin solvent.

3. An improved Diesel fuel composition comprising Diesel fuel in admixture with from 0.58 to 0.68 percent, by volume, of the additive composition of claim 1.

4. An improved Diesel fuel composition comprising Diesel fuel in admixture with about 0.60 percent, by volume, of the additive composition of claim 2, 5. A Diesel fuel additive composition comprising:
(a) 6.0 weight percent di-tertiary butyl peroxide,
(b) 1.0 weight percent tall oil fatty imidazoline,
(c) 0.5 weight percetn neo decanoic acid,
(d) the balance being a hydrocarbon solvent carrier thoroughly mixed with the peroxide, imidazoline, and acid.

6. The additive composition of claim 5 wherein the solvent is a low odor paraffin solvent.

7. An improved Diesel fuel composition comprising Diesel fuel in admixture with from 0.58 to 0.68 percent, by volume, of the additive composition of claim 5.

8. An improved Diesel fuel composition comprising Diesel fuel in admixture with about 0.60 percent, by volume of the additive composition of claim 6.

* * * * *